United States Patent [19]

Fischer

[11] 4,296,816

[45] Oct. 27, 1981

[54] HORIZONTAL SPRINKLER DEFLECTOR WITH FLOW LIFTING FORMATION

[75] Inventor: Michael A. Fischer, North Kingstown, R.I.

[73] Assignee: Grinnell Fire Protection Systems Company, Inc., Cranston, R.I.

[21] Appl. No.: 128,820

[22] Filed: Mar. 10, 1980

[51] Int. Cl.[3] ..... A62C 37/08

[52] U.S. Cl. ..... 169/37; 239/498; 239/500; 239/DIG. 1; 239/DIG. 7

[58] Field of Search ..... 169/37, 38, 39, 40, 169/41, 42, 57, 66, 68, 90; 239/498, 500, 504, 518, 521, 522, 523, 524, DIG. 1, DIG. 7

[56] References Cited

U.S. PATENT DOCUMENTS

| | | | |
|---|---|---|---|
| 691,758 | 1/1902 | Gay | 239/521 X |
| 820,328 | 5/1906 | Alderman | 239/498 |
| 2,108,652 | 2/1938 | Coanda | 239/DIG. 7 X |
| 2,775,485 | 12/1956 | Miller | 239/523 X |
| 3,904,126 | 9/1975 | Allard | 239/518 X |
| 3,982,696 | 9/1976 | Gordon | 239/DIG. 7 X |
| 4,191,331 | 3/1980 | Bivens et al. | 239/498 X |

*Primary Examiner*—Robert J. Spar
*Assistant Examiner*—Fred A. Silverberg

[57] ABSTRACT

A fire-protection sprinkler head with a deflector having a spray confining surface that includes a deformed area with relatively greater inclination than surrounding undeformed areas so as to selectively lift the flow entering the deformed area and thereby raise its trajectory relative to the flow passing underneath the undeformed areas.

19 Claims, 7 Drawing Figures

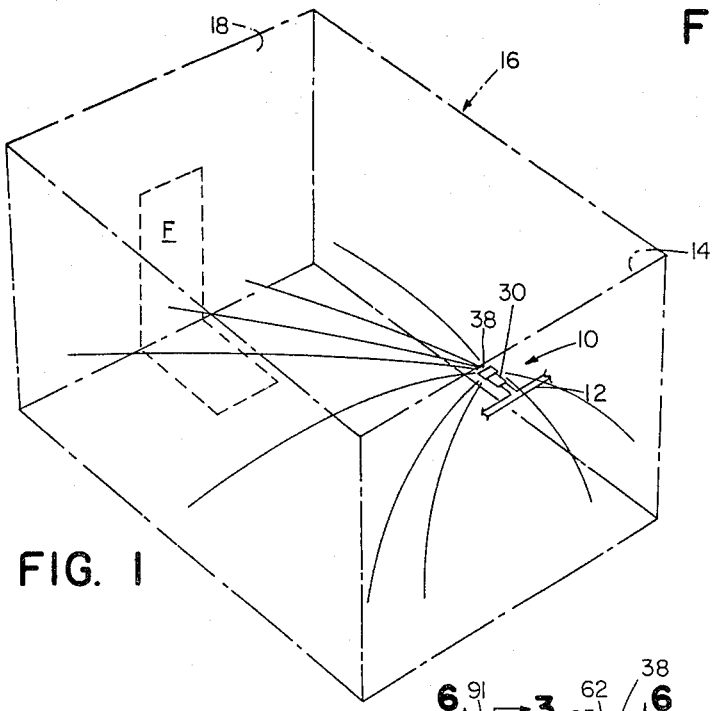
FIG. 1
FIG. 4
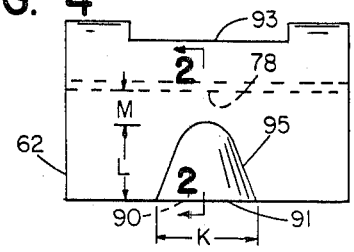
FIG. 3
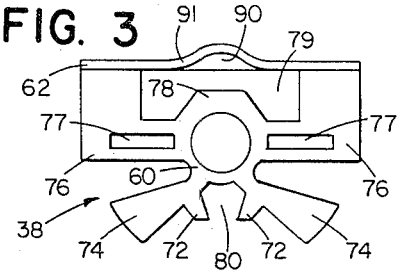
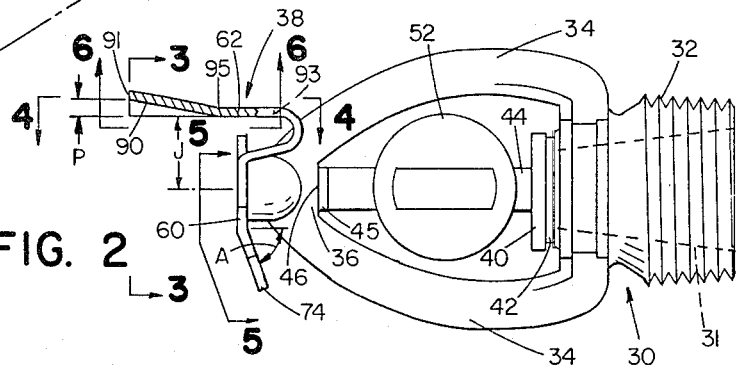
FIG. 2
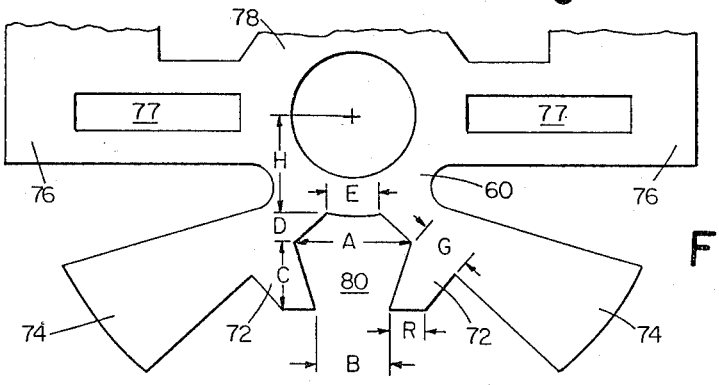
FIG. 5
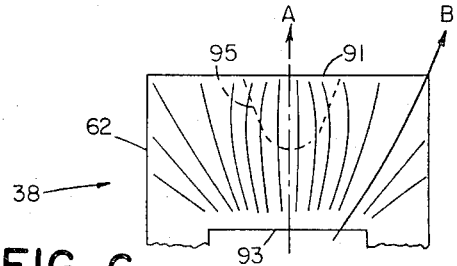
FIG. 6
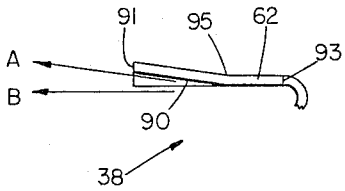
FIG. 7

HORIZONTAL SPRINKLER DEFLECTOR WITH FLOW LIFTING FORMATION

FIELD OF THE INVENTION

This invention relates to fire-protection sprinkler heads.

BACKGROUND OF THE INVENTION

Fire protection sprinkler heads generally include a deflector plate for producing a spray pattern of water (or other fire-retardant liquid). When a fire is sensed, a water stream emerging from the throat of the sprinkler head impinges on the deflector. Often the deflector contains a plurality of fluid deflecting elements (commonly referred to as tines) extending from a central hub, and the tines are relied upon to deflect the water in the desired spray pattern. There are applications, however, in which the deflector includes a surface along which the stream is directed, generally to confine the spray pattern in some way. One such application is the horizontal sidewall sprinkler head, which is generally installed near the top of a wall of a room. Water emerges in a horizontal stream from the throat of such a sprinkler. To aid in distributing the water to the far regions of the room, the upper half of the deflector includes an element that spreads the emerging stream into a fan-shaped spray. Above and extending downstream of this element is a horizontal plate or confining element that further shapes the spray so that it is directed below the ceiling, which may be in some cases within close proximity to the sprinkler head, and towards the far end of the room.

SUMMARY OF THE INVENTION

Horizontal sidewall sprinklers of the type just described tend to produce a spray pattern with less water density at the far center than at the far sides of the target area. For example, if one sprinkler head is used for a single room, the far center of the room receives less water than do the sides of the room. One cause of the low center density is that centrally-located arms attaching the deflector to the sprinkler head frame tend to obstruct the path of water emerging from the throat. Similarly, the deflector element used to spread the stream into a fan-shaped spray also tends to more greatly obstruct central portions of the spray than laterally outward portions. These obstructions tend to reduce the velocity of central portions of the spray and reduce the water density in the center of the spray. The resulting uneven coverage in far areas limits the room area that can be safely covered by a single sprinkler and means that more than one sprinkler must be used where one might otherwise be enough.

I have discovered that this uneven coverage can be substantially alleviated by upwardly deforming the confining element along a central area extending backward from the downstream end of the element to leave undeformed areas laterally adjacent to and upstream of the deformed area. The undersurface of the upwardly-deformed area is more greatly inclined with respect to the throat axis than are the surrounding undeformed areas, and the amount of inclination is chosen so that water entering the deformed area is selectively lifted upwardly from the flow direction of the remaining water, which flows generally parallel to the undersurface of the undeformed areas. The upward deformation gives a more inclined trajectory to the central portion of the spray, thereby allowing the central portion to reach more distant areas of the room. Also, it appears that some water from outlying regions of the confining surface bend their flow somewhat toward the center increasing the water distribution in that region.

Although I have just described my invention with reference to a horizontal sidewall sprinkler head, the invention can be applied to any sprinkler head in which a fluid stream is directed along and parallel to one surface of a confining element. The deformation is in a direction away from the ordinary parallel flow direction, and water entering the deformation does so because it remains attached to the deformed surface and is thereby lifted (by Coanda effect) from the main stream. The concentrating effect by which the deformed area effectively draws water from other regions is apparently due to the cohesiveness between the molecules of water.

PREFERRED EMBODIMENT

The structure of a preferred embodiment of the invention will now be described, after first briefly describing the drawings.

DRAWINGS

FIG. 1 is a perspective view of said embodiment installed on one vertical wall of a room.

FIG. 2 is a side view, partially cross sectioned, of said embodiment.

FIG. 3 is an enlarged frontal view of the deflector taken at 3—3 of FIG. 2.

FIG. 4 is a top view of the deflector taken at 4—4 of FIG. 2.

FIG. 5 is a fragmentary view of the lower half of the deflector taken at 5—5 of FIG. 3.

FIG. 6 is a diagrammatic view taken at 6—6 of FIG. 2, showing the streamlines of fluid flowing along the undersurface of the confining element.

FIG. 7 is a diagrammatic side view of the deflector and of the sprinkler head showing the inclined trajectory given fluid flowing within the upwardly deformed area.

STRUCTURE

Turning to FIG. 1, there is shown a horizontal sidewall sprinkler 10 installed in supply pipe 12 near the top center of wall 14 of a rectangular room 16 (indicated in broken lines). For reference purposes, wall 14, on which the sprinkler is mounted, is referred to as the near wall. Wall 18, opposite the sprinkler, is the far wall.

The sprinkler head is shown in cross section in FIG. 2. Body 30 (a machined bronze casting) has an internal passage or throat 31 for discharging water and threads 32 for attachment to a supply fitting. Integral arms 34 extend outward from body 30 to element 36, to which is attached deflector plate 38. Throat 31 (a frustoconical interior surface running along the horizontal axis through body 30) is normally sealed shut by button 40 and gasket 42, which are supported by strut 44. The opposite end of strut 44 rests in a groove in hook 45, the groove being offset slightly from fulcrum 46 on element 36, to provide mechanical advantage. Hook 45 is secured to the strut via a key member (not shown), a solder layer (not shown), and bell-shaped heat collector 52.

Turning to FIG. 3, there is shown a frontal view of deflector plate 38, which is cut from brass (0.049 to 0.053 inches thick). Extending from central hub portion 60 are a plurality of differently sized and shaped deflector elements 72, 74, 76, 78. Tines 72, 74 are bent back to an angle A (about 70°) (FIG. 2) from the horizontal plane of the central hub. Small tines 72 converge toward each other. Between tines 72 there is formed a slot 80, best seen in FIG. 5. The width of slot 80, over length D (0.06 inches), initially increases for greater radial distances from the hub to a maximum width A (0.26 inches), and then, over length C (0.14 inches), decreases, due to the converging orientation of tines 72, to a width B (0.16 inches). The root dimension E of slot 80 is approximately 0.12 inches. Converging tines 72 each have a dimension G of 0.12 inches at their base and a dimension R of 0.08 inches at their tip. The top of slot 80 is spaced a dimension H of 0.22 inches below the center of hub 60.

Above central hub 60 there is provided a confining element 62, extending outward horizontally (perpendicular to the vertical plane of the hub). The lower surface of the confining element is spaced a dimension J of about 0.39 inches above the center of the hub. The confining element is upwardly deformed at its downstream center to form channel 90, which extends upstream from downstream end 91 of element 62 by a dimension L (0.44 inches), to a point about midway between end 91 and upstream end 93. In plan view (FIG. 4), the boundary 95 between channel 90 and the surrounding flat-undeformed areas is generally parabolic in shape, with the vertex of the parabola at the upstream end of the channel. Undeformed areas surround the channel on both lateral sides and upstream. The undersurface of the channel is arcuate (upwardly concave and tapering, approximating a conical surface) with a radius of about 0.27 inches at downstream end 91, and the centerline of the undersurface is inclined at an angle of from 10° to 12° with respect to the undeformed areas. The channel smoothly merges into the undeformed area, with a fillet radius at boundary 95 of about 0.27 inches, the same as the maximum radius of the undersurface of the channel. The downstream mouth of the channel has a width K of 0.56 inches (which is less than half the downstream width of confining element 62) and a vertical depth (or height) P of about 0.08 inches. The upstream end of the channel is a distance M (about 0.20 inches) downstream of the upstream surface of tine 78 on the deflector hub.

OPERATION

When the sprinkler is activated (by fusing of the solder layer), strut 44 and button 40 are released, and water (or other fire-retardant liquid) flows through throat 31 in a stream directed at deflector plate 38, which produces and distributes a spray in a generally rectangular pattern to match the size of room 16. The sprinkler is designed to deliver a spray pattern of an acceptable minimum density throughout an area sixteen feet wide and twenty four feet long. Water is primarily directed at the floor and lower wall areas, including the near, side and far walls. As the height and contour of the ceiling above the sprinkler can vary for each installation, the ceiling is not depended upon to deflect the spray.

Each portion of deflector plate 38 serves a separate function in distributing the spray. Lower tines 74 distribute water onto the near wall and adjacent floor area (e.g., the first ten feet of floor). Long rectangular slots 77 distribute water onto the intermediate floor area. Confining element 62, upper tine 78, and aperture 79 control the distribution of water at the far wall and far floor area. Upper tine 78 causes water passing through aperture 79 to spread out in a fan-shaped horizontal spray. The width of aperture 79 determines the width of the horizontal spray. Confining element 62 directs the fan-shaped spray below the ceiling toward the far areas of the room.

Arms 34 and hub 60 tend to obstruct the path of water travelling along the vertical central plane of the sprinkler, and thus tend to reduce the amount of water reaching the center of the far wall and the center of the far floor, the two areas being shown in FIG. 1 as far region F. To compensate for the otherwise low water density in region F, channel 90 is formed in confining element 62. The undersurface of the channel is inclined (by about 11°) from the remainder of element 62 and thereby lifts the central portion of the water emerging from aperture 79 and travelling along the undersurface of element 62. This central portion is thereby given a slightly upward trajectory and the water density in region F is increased, without substantially reducing density in the far regions outside region F, e.g., the far corners.

Channel 90 functions as a Coanda effect surface; the central portion of the stream remains attached to the undersurface of the channel, and is thereby lifted upward. The channel does not function like a notch cut in element 62 to merely permit a stream already travelling in an upwardly inclined direction to continue along its trajectory. Instead it actually lifts upward the central stream, which is travelling horizontally (parallel to the undersurface of element 62). Experiments confirm this conclusion. When a sprinkler was tested with element 62 cut away along boundary 95, the improved performance achieved with the channel was not repeated. Instead the sprinkler performed much the same as it did with no channel and an entirely flat confining element.

FIG. 6 shows the streamlines of fluid travelling along the undersurface of the confining element. Channel 90 is indicated in dotted lines, and two arrows A, B represent the direction of flow leaving the element and headed for the far center and far corners respectively. FIG. 7 shows the inclination of flow directions A and B; flow headed for the far center (arrow A) is inclined upwardly whereas flow headed for the corners (arrow B) is directed horizontally.

Another advantageous effect of channel 90 is that portions of the stream diverging laterally away from straight ahead are caused to follow laterally curved paths that initially diverge but then curve back toward the channel and centerline of the confining element. These curved streamlines are illustrated in FIG. 6. This increases the density of water in the center of the spray, and thereby further increases the spray density reaching the far center of the room. To achieve this streamline curvature it is important to provide a smooth transition at boundary 95 between the channel 90 and the undeformed area and similarly to gradually slope the walls of the channel. (In the embodiment shown, the channel is arcuate in transverse section and thus the walls and roof of the channel are all one arcuate portion.)

Another important consideration in shaping the confining element of the preferred embodiment is that there be no sharp corners, flow restrictions, or other discontinuities that would remove kinetic energy from the flow. Unlike the flow that is deflected toward the intermediate and near regions of the room by the lower portions of the deflector, the flow passing through the upper portion of the deflector and along the confining element must retain as much kinetic energy as possible in order to reach the far areas of the room. The smoothly shaped channel 90 achieves a redistribution of flow without substantial energy loss. (It should be noted, however, that in other applications wherein spray distances are not as critical or wherein flow energy loss is not as important, the deformation in the confining element need not be as smoothly shaped.)

OTHER EMBODIMENTS

Other embodiments of the invention are included within the scope of the following claims. For example, such a deformed confining element could be used to selectively alter spray trajectories in sprinklers other than the horizontal sidewall type disclosed herein, and more than one channel could be used on confining element 62 should there be other than one target area requiring greater spray density. Also, the shape of the boundary between the deformed and undeformed areas as well as the contour of the deformed area can be varied in order to achieve the desired density in the target area. The term deformed area is used in a topological sense; channel 90 could be formed by a variety of methods in addition to deforming element 62. Furthermore, more than one sprinkler may be used for a room and the spray pattern of any one sprinkler may be other than rectangular.

OTHER INVENTIONS

The subject matter relating to converging lower tines 72 was the invention of James W. Mears, and his invention preceded mine.

What is claimed is:

1. In a fire-protection sprinkler head of the horizontal-sidewall type, including a throat through which a horizontal stream of fire-retardant fluid can flow, a deflector spaced from said throat and in the path of said stream for generating a spray into an area, said deflector including a generally planar confining element more nearly horizontal than vertical disposed above the longitudinal axis of said throat for the purpose of confining the upward trajectory of a portion of said stream and a deflector structure below said element for the purpose of deflecting and distributing other portions of said stream in various desired directions, said confining element extending generally longitudinally along the direction of said axis from an upstream end to a downstream end, a portion of said stream being incident upon the undersurface of said confining element and being caused to flow generally parallel to said under surface from said upstream end to said downstream end, the improvement wherein said confining element is deformed upwardly along an area extending longitudinally from said downstream end to a region intermediate said upstream and downstream ends, thereby forming an upwardly-deformed area and generally undeformed areas laterally adjacent to said upwardly-deformed area, the undersurface of said upwardly-deformed area being inclined upward relative to the undersurfaces of said generally undeformed areas, and said upward inclination being chosen so that a portion of said stream entering said upwardly-deformed area is lifted upwardly from a flow direction generally parallel to the undersurface of said generally undeformed areas to a relatively upwardly inclined flow direction, whereby the lifted portion of said stream departs from said confining element with a trajectory more upwardly inclined than the trajectory of other portions of said stream, thereby causing said lifted portion to reach more distant areas from said sprinkler head.

2. The sprinkler head of claim 1 wherein said upwardly-deformed area forms a Coanda-effect surface for lifting said flow.

3. The sprinkler head of claim 1 wherein said upwardly-deformed area defines a longitudinally-extending channel, said channel is generally upwardly concave in transverse section, and the lateral width and vertical depth of said channel increases along the longitudinal axis of said throat from the upstream end to the downstream end.

4. The sprinkler head of claim 3 wherein said lateral width and vertical depth are negligible at said intermediate region where said channel begins and increase uniformly along the longitudinal axis of said throat from the upstream end to the downstream end.

5. The sprinkler head of claim 3 or 4 wherein there is only one said channel and it is centrally located in said confining element directly above the axis of said throat, thereby raising the trajectory of fluid emerging from the center of said confining element.

6. The sprinkler head of claim 5 wherein there is at least one support arm extending from a frame portion encompassing said throat to said deflector and said arm is located within a central planar zone which extends vertically above and below the axis of said throat and said channel is shaped and sized to increase the distance by which fluid departing centrally from said confining element is sprayed so as to compensate for the reduced flow along the center of said confining element resulting from the blockage of said stream caused by the centrally-located arm.

7. The sprinkler head of claim 5 wherein said intermediate region at which said channel begins is generally midway between said upstream and downstream ends.

8. The sprinkler head of claim 5 wherein the angular inclination of the center of said channel with respect to said undeformed areas is between 5 and 15 degrees.

9. The sprinkler head of claim 5 wherein said undeformed areas are generally planar.

10. The sprinkler head of claim 5 wherein said channel is arcuate in transverse section.

11. The sprinkler head of claim 5 wherein the boundary dividing said channel from said undeformed areas is generally parabolic in shape with the open end at said downstream end and the vertex at said intermediate region.

12. The sprinkler head of claim 3 wherein said channel has two walls that smoothly merge into said undeformed areas on either lateral side and said merger is sufficiently smooth and the slope of said walls along the lateral direction is sufficiently gradual to cause portions of said stream flowing underneath said confining element to follow laterally curved paths further downstream that initially diverge laterally but curve back toward said channel and toward the center line of said confining element.

13. The sprinkler head of claim 12 wherein there is only one said channel and it is centrally located in said confining element directly above the axis of said throat, thereby raising the trajectory of fluid emerging from the center of said confining element and increasing the amount of water so emerging from the center as a result of said lateral redirection of flow toward said channel, whereby a greater spray density can be achieved in the distant central region of said area, said distant central region being that region longitudinally ahead of said sprinkler head and at the furthest longitudinal distance from said sprinkler head.

14. The sprinkler head of claim 1 or 3 wherein said deflector further comprises a fluid deflecting element upstream of and below said confining element for spreading a portion of said stream emerging from said throat into a spray that is incident upon said undersurface of said confining element at a region upstream of said deformed area.

15. The sprinkler head of claim 3 wherein said channel width at said downstream end is less than half the width of said confining element at said downstream end.

16. The sprinkler head of claim 1 wherein said deformed area is upwardly concave in transverse section and tapering longitudinally so as to be substantially conical.

17. The sprinkler head of claim 1 wherein said undeformed areas include an upstream of said deformed area.

18. In a fire-protection sprinkler head, including a throat through which a nearly horizontal stream of fire-retardant fluid can flow, a deflector spaced from said throat in the path of said stream for generating a spray into an area, said deflector including a generally horizontal confining element disposed above the longitudinal axis of said throat of said stream and a deflector structure below said element for the purpose of deflecting and distributing other portions of said stream in various desired directions, said confining element extending generally longitudinally along the direction of said axis from an upstream end to a downstream end, a portion of said stream being incident upon the undersurface of said confining element and being caused to flow generally parallel to said under surface from said upstream end to said downstream end, the improvement wherein said confining element is deformed upwardly along an area extending longitudinally from said downstream end to a region intermediate said upstream and downstream ends, thereby forming an upwardly-deformed area and generally undeformed areas laterally adjacent to said upwardly-deformed area, the undersurface of said upwardly-deformed area being inclined upward relative to the undersurfaces of said generally undeformed areas, and said upward inclination being chosen so that a portion of said stream entering said upwardly-deformed area is lifted upwardly from a flow direction generally parallel to the undersurface of said generally undeformed areas to a relatively upwardly inclined flow direction, whereby the lifted portion of said stream departs from said confining element with a trajectory more upwardly inclined than the trajectory of other portions of said stream, thereby causing said lifted portion to reach more distant areas from said sprinkler head.

19. The sprinkler head of claim 18 wherein there is a single channel centrally located in said confining element.

* * * * *